US007478763B2

(12) United States Patent
Mauchle et al.

(10) Patent No.: US 7,478,763 B2
(45) Date of Patent: Jan. 20, 2009

(54) SPRAY COATING DEVICE FOR SPRAYING COATING MATERIAL, IN PARTICULAR COATING POWDER

(75) Inventors: Felix Mauchle, Abtwil (CH); Hanspeter Vieli, Goldach (CH); Hanspeter Michael, Gossau (CH)

(73) Assignee: ITW Gema GmbH, St. Gallen (CH)

( * ) Notice: Subject to any disclaimer, the term of this patent is extended or adjusted under 35 U.S.C. 154(b) by 0 days.

(21) Appl. No.: 10/837,908

(22) Filed: May 4, 2004

(65) Prior Publication Data

US 2005/0001061 A1 Jan. 6, 2005

(30) Foreign Application Priority Data

May 5, 2003 (DE) ..... 103 19 916

(51) Int. Cl.
*A62C 5/02* (2006.01)

(52) U.S. Cl. ..... 239/8; 239/298; 239/291; 239/296; 239/419.5; 239/425.5; 239/704; 239/690

(58) Field of Classification Search ..... 239/602, 239/690, 690.1, 693, 697, 702, 705, 706, 239/708, 290, 298, 704, 423, 419–5, 425.5, 239/424, 292, 291, 296, 8
See application file for complete search history.

(56) References Cited

U.S. PATENT DOCUMENTS

| | | | | | |
|---|---|---|---|---|---|
| 2,138,300 | A | * | 11/1938 | Gustafsson | 239/8 |
| 2,410,532 | A | * | 11/1946 | Tessier | 239/291 |
| 2,980,786 | A | * | 4/1961 | Chilton | 239/135 |
| 3,258,207 | A | * | 6/1966 | Cody | 239/336 |
| 3,659,151 | A | * | 4/1972 | Fabre | 361/227 |
| 3,857,511 | A | * | 12/1974 | Govindan | 239/11 |
| 3,902,669 | A | * | 9/1975 | Keibler | 239/227 |
| 4,196,465 | A | | 4/1980 | Buschor | |
| 4,218,019 | A | * | 8/1980 | Baldwin et al. | 239/290 |
| 4,324,361 | A | | 4/1982 | Moos et al. | |
| 4,347,984 | A | | 9/1982 | Sickles | |
| 4,505,430 | A | | 3/1985 | Rodgers et al. | |
| 5,011,086 | A | | 4/1991 | Sonnleitner | |
| 5,620,138 | A | * | 4/1997 | Crum | 239/3 |
| 5,865,380 | A | * | 2/1999 | Kazama et al. | 239/704 |
| 6,003,779 | A | | 12/1999 | Robidoux | |
| 6,006,999 | A | * | 12/1999 | Tiessen et al. | 239/3 |
| 6,135,365 | A | * | 10/2000 | Kuwahara | 239/296 |
| 6,189,804 | B1 | | 2/2001 | Vetter et al. | |

FOREIGN PATENT DOCUMENTS

| | | |
|---|---|---|
| DE | 34 31 785 | 3/1986 |
| DE | 34 12 694 A1 | 4/1988 |
| EP | 0 767 005 | 4/1997 |
| EP | 0 744 998 | 9/1998 |
| WO | 85/01894 | 5/1985 |

* cited by examiner

*Primary Examiner*—Dinh Q Nguyen
(74) *Attorney, Agent, or Firm*—Lowe Hauptman, Ham & Berner, LLP

(57) ABSTRACT

A spray apparatus for coating material, in particular for coating powders, contains a spray outlet spraying the coating material, a shaping air outlet in the form of a plurality of holes shaping the spray jet and an ambient-air passage radially configured between the spray outlet and the holes to aspirate ambient air by means of the flow suction effect of the spray jet and/or of the shaping air flow.

15 Claims, 2 Drawing Sheets

SPRAY COATING DEVICE FOR SPRAYING COATING MATERIAL, IN PARTICULAR COATING POWDER

BACKGROUND OF THE INVENTION

The present invention relates to a spray apparatus for coating materials, in particular for coating powders.

In particular the present invention relates to a spray apparatus comprising at least one high-voltage electrode electrostatically charging the coating material. However it also applies to spray apparatus which are not designed to electrostatically charge coating materials.

Spray apparatus of this kind are known for instance from the patent documents U.S. Pat. No. 4,324,361; DE 34 12 694 A1; U.S. Pat. Nos. 4,505,430; 4,196,465; 4,347,984 and 6,189,804.

Spray apparatus fitted with shaping-air outlets of annular gap geometry incur the drawback that if said gap is supported along its longitudinal direction at several places, manufacturing constraints will preclude uniform gap size. Such a drawback however is averted by using boreholes instead of an angular gap, especially if the body containing said boreholes remains undivided at the borehole site. Illustratively such spray apparatus are shown in the patent documents EP 0 767 005 B1; EP 0 744 998 B1 and DE 34 31 785 C2.

SUMMARY OF THE INVENTION

The objective of the present invention is to attain equal or better efficiency in controlling the coating material spray flow and the quantity of coating material required for such coating while using less shaping air per unit time.

Accordingly the present invention relates to a spray apparatus for coating materials, in particular coating powder, said spray apparatus comprising a coating material duct; a spray outlet at the downstream end of the coating material duct to spray the coating material onto an object to be coated; a shaping air outlet for compressed shaping air, said outlet being configured near the spray outlet and around the flow path of the coating material, said outlet being separate from the flow path and designed to generate from compressed air a shaping air flow enclosing the coating material spray jet; the shaping outlet being constituted by a large number of holes in a body, said holes being configured in distributed manner around the coating material flow path and being apart from latter and pointing toward the coating material spray jet, characterized by an ambient air passage which is configured a distance from said holes and is radially offset inward, said passage extending from an ambient air intake situated behind the body containing said holes to an air outlet situated in front of said body, said passage running integrally or in the form of several apertures around and separately of said flow path, so that, on account of flow suction caused by the coating material spray jet and/or caused by the flow suction of the shaping air flow, the ambient air may be aspirated from the rearward air intake through the ambient air passage into the forward air outlet

BRIEF DESCRIPTION OF THE DRAWINGS

The present invention is elucidated below by an illustrative and preferred embodiment and in relation to the appended drawings.

FIGS. 1 and 2 show only one of many embodiment modes of the present invention.

DETAILED DESCRIPTION OF THE PREFERRED EMBODIMENTS

Figure 1:
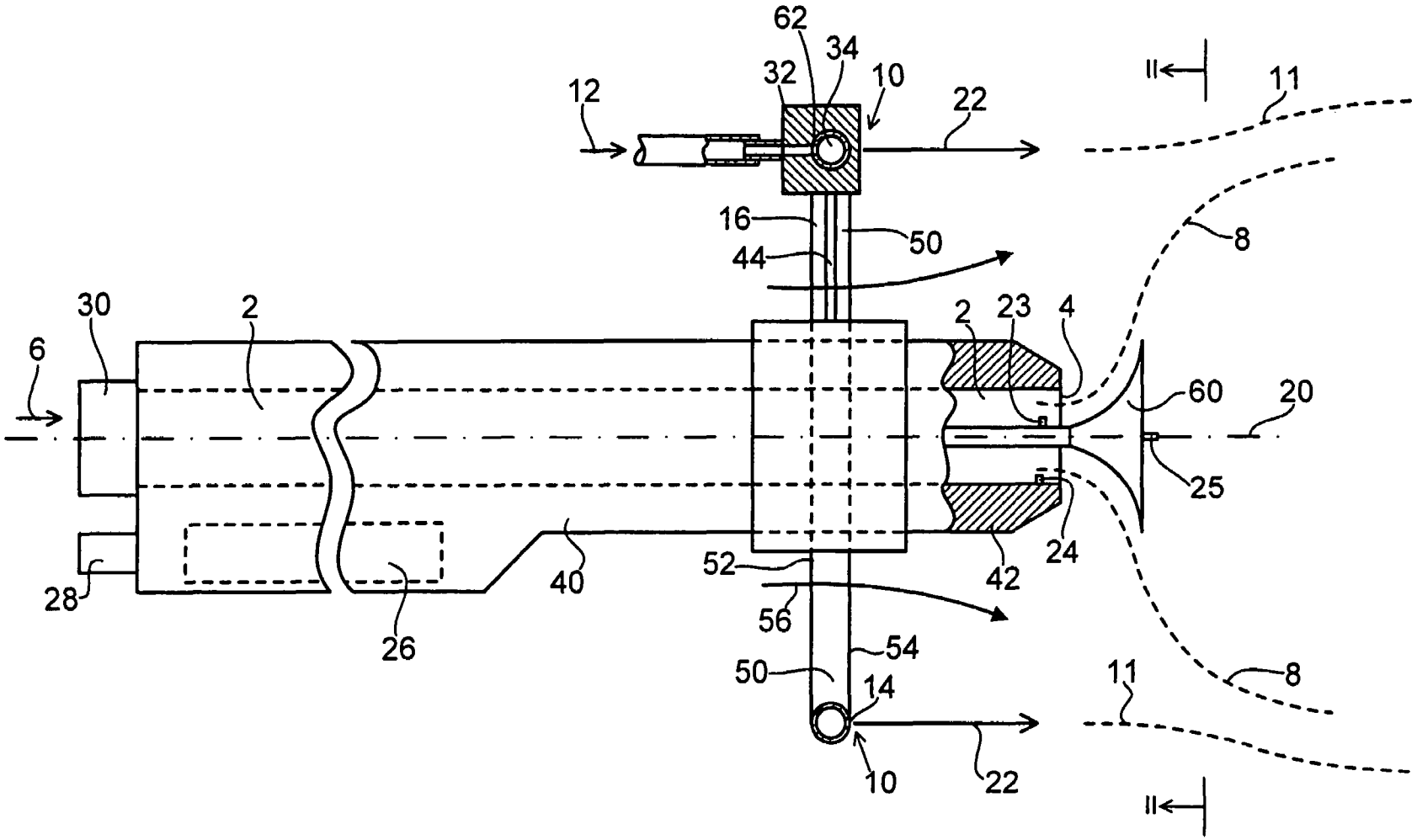
FIG. 1 schematically shows a cutaway view of the invention (not to scale)
Figure 2:
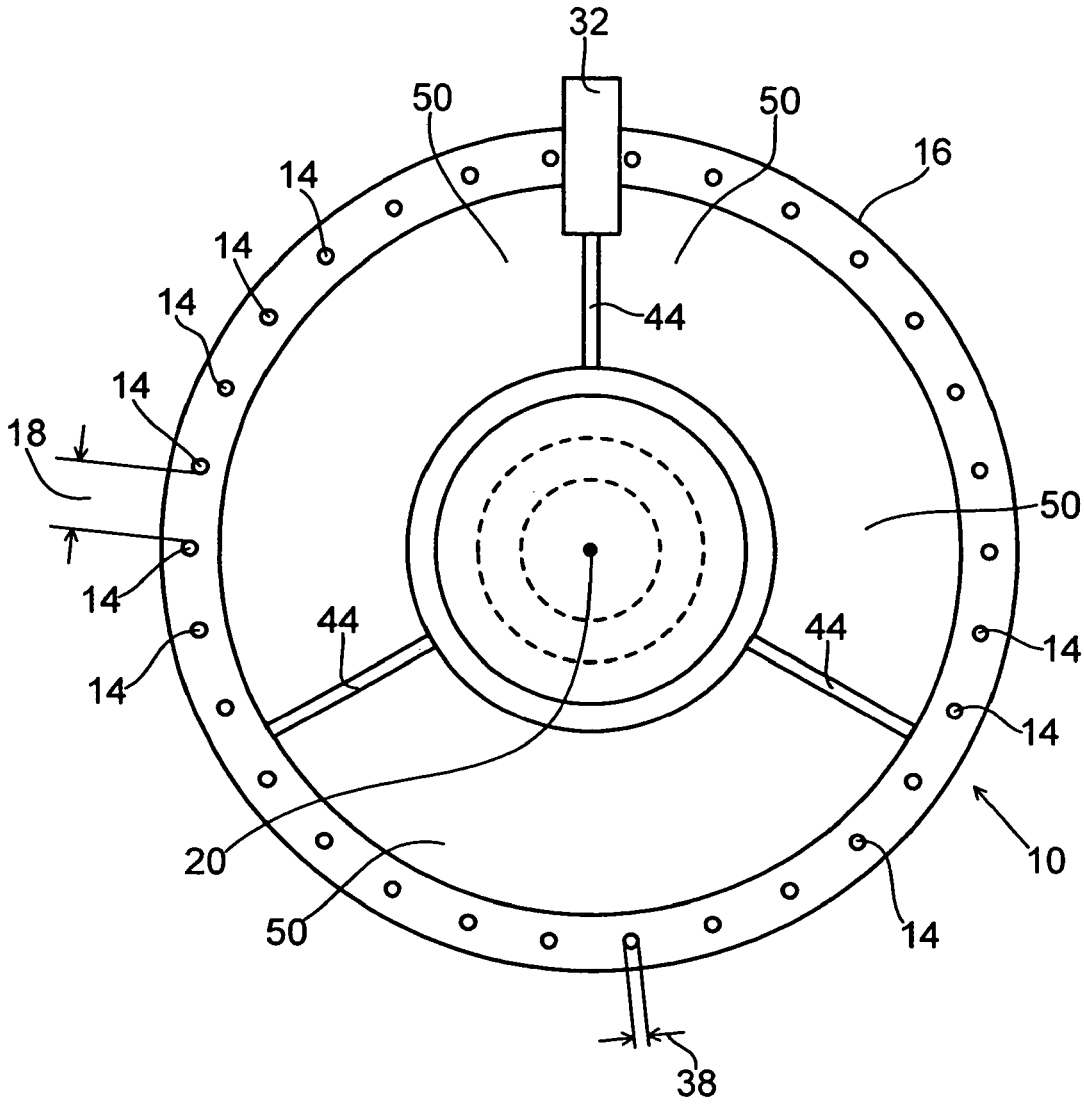
FIG. 2 is a front view of the spray apparatus of FIG. 1 in the direction of the arrows II.

The spray apparatus shown in FIGS. 1 and 2 is designed to spray coating powder, though it may also be used to spray liquid coating materials.

The spray apparatus contains a coating material duct 2; a spray outlet 4 at the downstream end of said coating material duct 2 in order to spray the coating material 6 in the form of a flow 8 onto an (omitted) object to be coated, and a shaping air outlet 10 of compressed shaping air 12, said outlet 10 running around and apart from the flow path of the coating material 6 in order to generate from the compressed shaping air 12 a shaping air flow 11 enclosing the coating material spray jet 8.

The shaping air outlet 10 consists of a large number of holes 14 through the body 16 which is undivided at said holes, these holes being distributed around and apart from the flow path of the coating material 6.

In the embodiment shown in FIGS. 1 and 2, all the holes 14 are configured at identical circumferential distances 18 from one another and concentrically with the axial center axis 20 of the flow path of the coating material 6. Instead of being circular, said holes also may assume other geometries, for instance being ovally or polygonally framed, around the axial center axis 20 in order to generate a particular cross-sectional form of the spray flow 8.

The equidistant space 8 between the holes 14 is sufficiently small that the shaping air jets 22 exiting from them will converge into a cross-sectionally annular shaping air flow, preferably immediately after the holes 14 and before they impact the spray flow 8, but at the latest at the point of impact with the spray flow 8.

Seen in the direction of coating material spraying, the holes 14 point forward and preferably parallel to the axial center axis 20, and preferably they are present in a forward pointing end face. In another embodiment mode they also may point obliquely to the axial center axis 20, either toward or away from it. The cross-sectional shape and size of the spray flow 8 may be adjusted by the direction of the holes 14 relative to the axial center axis 20 and by the pressure of the compressed air 12.

One or preferably several electrodes, for instance 23, 24 and/or 25 are configured in or near the coating material flow path or at or near the spray outlet 4 and is/are connected to a high voltage generator 26 for the purpose of electrostatically charging the coating material 6. The high voltage generator 26 may be mounted outside the spray apparatus or, as shown in FIG. 1, within it. From AC, said voltage generator produces a high DC voltage for instance in the range of 4 kv to 150 kv. The spray apparatus is fitted with a low AC connector 28 to apply a low voltage AC to the high voltage generator 26; further with a coating material connector 30 to apply coating material to the coating material duct 2; and a shaping compressed air connector 32 to apply compressed shaping air 12 to a manifold duct 34 mutually connecting the holes 14 on their upstream side.

At least ten or more holes 14 are present, for instance at least twenty, thirty or forty, or any arbitrary large number. The circumferential equidistant spacing 18 between the holes 14 is at least twice as large as or larger than the aperture size 38 of the holes 14 as seen in the circumferential direction about the axial center axis 20. Preferably however such a multiplying factor shall be larger, illustratively being five or more, for instance ten or more. The cross-section of the aperture of each hole 14 is less than 2 $mm^2$, for instance being less than 1.0 $mm^2$ or even better less than 0.5 $mm^2$ or less than 0.3 $mm^2$. The holes should be made as small as possible in practice in order to generate thereby the least possible quantity per unit time of shaping air flow with which to attain a rapidly moving, high-energy shaping air jet 22 at each hole 14 and hence a rapidly moving, high-energy shaping air flow 11. As a result, with low quantities of air per unit time, the cross-sectional shape and size of the spray flow 8 can be effectively controlled. Because the cross-section of the particular holes 14 is very small, a uniform quantity of flowing shaping air per unit time shall be attained at all holes even when all holes 14 exhibit the same size cross-section and the manifold duct 34 and the cross-section of exhibits a constant cross-section over its full length. The small cross-section of the holes 14 implements uniform distribution of compressed air over the full length of the manifold duct 34. The sum of all the cross-sections of all holes 14 is less, for instance being only half as large, as the flow cross-section of the manifold duct 34.

Preferably the holes 14 each shall be circular in cross-section though they also may exhibit a different cross-section, for instance being cross-sectionally polygonal. The holes 14 may be manufactured during the making of the body 16 of which they are part while the latter is being produced, illustratively by injection molding the body 16 and simultaneously manufacturing the holes 14. In another preferred embodiment mode, the holes 14 are made by being drilled into the body 16. The body 16 may be made of a rigid material, for instance being a metallic or a plastic tube, or it may be made of an elastic or flexible material, for instance a hose illustratively made of rubber or plastic.

In the embodiment of FIGS. 1 and 2, the body 16 is a hose or a tube into which were drilled the holes 14 and of which the inside space constitutes the manifold duct 34. The body 16 may be part of the housing 40 or it may be a housing component affixed to this housing 40 of the spray apparatus 2, or, as indicated in FIGS. 1 and 2, it may be an additional body 16. This additional body 16 is mounted in the spray apparatus housing 40, though it also may be mounted on another element in turn affixed to the housing, for instance on a front terminal component 42 constituting the spray outlet 4 or containing it and affixed to the housing 40.

In the preferred embodiment mode, the discharge end of the holes 14 is offset backward upstream of the spray outlet 4. In other embodiment modes, however, the discharge ends of the holes 14 may be situated in the same transverse plane or downstream of this transverse plane wherein is also contained the spray outlet 4. The essential point is that the shaping air flow 11 shall enclose the spray flow 8 so tightly at the spray outlet 4 that no coating material particles may escape from the flow of coating material radially outward or rearward onto the spray apparatus's outer surfaces.

The holes 14 can be manufactured with substantially greater accuracy at a given size than can be gaps circumferentially running about the axial center axis 20. Moreover the holes are less exposed to the danger of thermal changes in size and external mechanical effects such as shocks when impacting other objects.

The body 16 fitted with the holes 14 is affixed by one or several elements 44—preferably by mechanical webs with spaces between them, directly or by intermediate means—to the housing 40, as a result of which the body 16 rests on the housing 40.

In a preferred embodiment mode of the present invention, an ambient air passage 50 is mounted at a radially inward offset from the holes 14 and runs from an ambient air intake 52 situated behind the body 16 fitted with holes 14 to an air exit 54 situated in front of the body 16, said passage 50 being in the form of one or more slots or other apertures and running around but apart from the flow path of the coating material 6, and therefore also around the axial center axis 20, as a result of which ambient air 56 may be aspirated through said ambient air passage 50 on account of the suction caused by the coating material spray flow 8 and/or by the suction caused the compressed shaping jets 22 and the shaping air flow 11 from the rear air inlet 52 to the forward air outlet 54. This ambient air passage 50 precludes the coating material particles from flowing back onto the spray apparatus's outer surfaces and on its body 16 fitted with the holes 14. In this manner said component are protected against soiling.

In the above shown embodiment mode, all holes 14 are connected for (pneumatic) flow by means of the compressed air manifold duct 34 to a compressed air inlet aperture 62. In an omitted embodiment mode, two or more sets of such holes 14 may be mutually connected for flow by means of a segment of the manifold duct 34, the said segments being isolated as regards flow from one another and each segment being fitted with its own compressed air intake aperture 62. The latter design allows finer adjustment of the quantity of compressed air per unit time issuing from the holes 14, preferably to the extent that the same rate issues from all holes, or, in yet another embodiment mode, that defined and different rates shall issue.

In both embodiment modes, the aperture cross-section of the manifold duct 34 (or its mutually separate segments) and the aperture cross-sections of the holes 14 are matched to each other in a manner that the same quantity of compressed air per unit time may issue from all holes 14. The quantity of compressed air per unit time issuing from the holes 14 depends on the flow impedance in the manifold duct 34 between the intake aperture 62 and the particular hole 14. Identical quantities of compressed air per unit time may be attained at all holes 14 in that either the manifold duct 34 sees an ever lesser impedance in the direction from the nearest hole 14 to the most remote hole 14 or preferably in that as the distance between the hole and the compressed air intake aperture 62 increases, said holes shall exhibit a larger aperture cross-section. In this instance that hole 14 subtending the shortest flow path from the inlet aperture 62 shall exhibit the smallest aperture cross-section and that hole 14 which is the most remote shall exhibit the largest aperture cross-section. However such designs are laborious and expensive. Still they may be used in the present invention. On the other hand the aperture cross-sections of the invention are so small as discussed above that even in the absence of such designs an identical or nearly identical shaping air flow is attained at all holes 14.

The embodiment modes of the present invention are applicable to all kinds of coating material spray apparatus, especially those for powder coating materials, illustratively spray apparatus comprising a spray outlet in the form of a circularjet nozzle or a fan jet nozzle, those assuming cylindrical or funnel-like geometries, with or without baffles 60, and also to spray apparatus of which the spray outlet 4 is fitted with a rotary element or consist of such. Moreover the present invention is applicable to corona spray apparatus generating corona discharges at least one of the high voltage electrodes 23, 24, 25, and furthermore so-called tribo spray apparatus wherein the particles of the spray coating material are electrostatically charged by being rubbed within the coating material duct 2.

The present invention allows attaining homogeneous air distribution of the shaping compressed air around the spray flow 8. Only a small quantity of compressed air per unit time is required for that purpose. The shaping air flow 11 produced in the manner of the present invention stabilizes the spray flow 8 which assumes the form of a spray cloud rather than a spray jet. This spray flow or spray cloud 8 is substantially less sensitive to air flows in a coating cabin than in the state of the art. This feature offers the further advantage that the coating powder's efficiency of deposition for a given object to be coated and the quality of coating, i.e. coating uniformity, shall be substantially raised.

Spray apparatus of this kind are conventionally denoted as "spray guns", both when they comprise a grip for manual operation and when they are designed as straight or angled automated spray guns held by an appropriate support, for instance a robot, a stand or a fixed support.

The invention claimed is:

1. Spray apparatus for coating materials comprising an apparatus housing, the apparatus housing further comprising:

a coating powder duct;

a spray outlet at a downstream end of the coating material duct, the spray outlet configured to spray the coating material onto an object to be coated;

a shaping air outlet configured to adjustably shape compressed air, said shaping air outlet running near the spray outlet and around a flow path of the coating material apart from the flow path; and at least one electrode arranged in the flow path of the coating material at or close to the spray outlet, the at least one electrode configured to be connected to a high-voltage generator for electrostatic charging of the coating material;

wherein the shaping air outlet is further configured to generate from compressed air, a shaping air flow enclosing a coating material spray jet, the shaping air outlet comprising a large number of holes in a body, said holes being configured in a distributed manner around the flow path of the coating, separated from the flow path, and pointing forward to the coating material spray jet, the holes being further configured such that the shaping air flow from the holes will converge to a cross-sectionally annular shaping air flow at the latest at a point of impact of the air flow with the flow path of the coating material spray jet, the distributed manner comprising an ambient-air passage that is radially inwardly offset relative to the holes and which runs from an ambient-air inlet situated behind the body to an ambient-air outlet situated in front of the body; and which further runs in the form of a single component or in the form of several apertures around and apart from the flow path of the coating material, whereby the ambient air can be aspirated from the ambient air inlet through the ambient-air passage toward the ambient-air outlet by means of a flow suction effect of the coating material spray jet and/or the flow suction effect of the shaping air flow.

2. The spray apparatus as claimed in claim 1, wherein the body is undivided at the holes.

3. The spray apparatus as claimed in claim 1, wherein there are at least ten or more holes.

4. The spray apparatus as claimed in claim 1, wherein a mutual distance between adjacent holes as seen in a circumferential direction around the flow path of the coating material is larger by a factor of at least five or more, preferably at least ten or more than the aperture size of the holes in said circumferential direction.

5. The spray apparatus as claimed in claim 1, wherein the aperture cross-section of each hole is less than 2 $mm^2$.

6. The spray apparatus as claimed in claim 1, wherein the holes exhibit a circular cross-section.

7. The spray apparatus as claimed in claim 1, wherein the body is a hose or a tube enclosing the flow path of the coating material while being apart from it, and in that the holes are present in a wall of the hose or the tube.

8. The spray apparatus as claimed in claim 1, wherein an outlet end of the holes is configured in a rearwardly offset manner relative to the spray outlet at the upstream side.

9. The spray apparatus as claimed in claim 1, wherein all the holes are pneumatically connected to a compressed-air manifold duct which is fitted with at least one compressed-air inlet aperture.

10. The spray apparatus as claimed in claim 9, wherein an aperture cross-section of the manifold duct and an aperture cross section of the holes are mutually matched in a manner that a same quantity of compressed air per unit time may issue from all the holes.

11. The spray apparatus as claimed in claim 1, further comprising a baffle disposed downstream of the spray outlet, the baffle including an electrode axially orientated downstream of the baffle.

12. The spray apparatus as claimed in claim 1, further comprising a high voltage generator disposed within the apparatus housing, the high voltage generator configured to generate a high DC voltage applied to the at least one electrode from a received low voltage alternating current (AC) source.

13. The spray apparatus as claimed in claim 1, further comprising at least two set of air shaping holes connected to separate sections of a air manifold duct and fitted with separate compressed air intake apertures, enabling finer adjustment of the quantity of compressed air per unit time issuing from the holes.

14. A method of spraying a coating material, comprising:

forming a coating material spray jet for spraying the coating material onto an object to be coated from a spray outlet at a downstream end of a spray apparatus having a coating material duct;

adjustably shaping compressed air exiting air outlet running near the spray outlet and around a flow path of the coating material jet apart from the flow path, the compressed air exiting the air outlet via a large number of holes configured in a distributed manner around the flow path of the coating, separated from the flow path, and pointing forward to the coating material spray jet, the holes being further configured such that the shaping air flow from the holes will converge to a cross-sectionally annular shaping air flow at the latest at a point of impact of the air flow with the flow path of the coating material spray jet, the distributed manner comprising an ambient-air passage that is radially inwardly offset relative to the holes and which runs from an ambient-air inlet situated behind the body to an ambient-air outlet situated in front of the body; and which further runs in the form of a single component or in the form of several apertures around and apart from the flow path of the coating material; and aspirating ambient air from the ambient air inlet through the ambient-air passage toward the ambient-air outlet by means of a flow suction effect of the coating material spray jet and/or the flow suction effect of the shaping air flow.

15. The method of claim 14, wherein shaping compressed air exiting an air outlet is performed by at least two sets of holes supplied by separate compressed air intake apertures, enabling finer adjustment of the quantity of compressed air per unit time issuing from the holes.

* * * * *